US005640639A

United States Patent [19]

Pagano et al.

[11] Patent Number: 5,640,639

[45] Date of Patent: Jun. 17, 1997

[54] PHOTOGRAPHIC PROCESSING APPARATUS

[75] Inventors: Daniel Michael Pagano, Henrietta; Kevin John Klees, Rochester, both of N.Y.

[73] Assignee: Eastman Kodak Company, Rochester, N.Y.

[21] Appl. No.: 576,424

[22] Filed: Dec. 21, 1995

[51] Int. Cl.[6] ..... G03D 3/08

[52] U.S. Cl. ..... 396/623; 396/626

[58] Field of Search ..... 354/322, 324, 354/331, 336, 308–310, 313; 352/56, 72, 78; 396/633, 648, 623, 626

[56] References Cited

U.S. PATENT DOCUMENTS

| | | | |
|---|---|---|---|
| 2,112,605 | 3/1938 | Pless | 354/313 |
| 2,498,477 | 2/1950 | Alk | 354/310 |
| 2,562,877 | 8/1951 | Bulluff | 354/310 |
| 2,595,898 | 5/1952 | Siedenburg | 242/602.3 |
| 2,692,541 | 10/1954 | Lesjak | 354/310 |
| 2,710,727 | 6/1955 | Orowick | 242/609.4 |
| 3,383,998 | 5/1968 | Takats | 396/623 |
| 3,492,932 | 2/1970 | Van Baerle | 354/322 X |
| 3,641,910 | 2/1972 | Smith | 396/623 |
| 3,724,353 | 4/1973 | Holbert | 354/313 |
| 3,888,675 | 6/1975 | Corrigan | 354/88 X |
| 4,375,324 | 3/1983 | Holmes | 354/303 |
| 4,410,257 | 10/1983 | Thebault | 354/313 X |
| 4,834,306 | 5/1989 | Robertson et al. | 354/275 |
| 4,954,838 | 9/1990 | Nakamura et al. | 354/331 X |
| 5,023,644 | 6/1991 | Kurematsu et al. | 354/320 |
| 5,029,313 | 7/1991 | Robinson et al. | 355/40 |
| 5,093,686 | 3/1992 | Shigaki | 355/77 |
| 5,231,439 | 7/1993 | Takahashi et al. | 354/313 |
| 5,543,882 | 8/1996 | Pagano et al. | 354/313 X |

FOREIGN PATENT DOCUMENTS

| | | |
|---|---|---|
| 0709733 | 5/1996 | European Pat. Off. . |
| 382537 | 10/1932 | United Kingdom . |

*Primary Examiner*—D. Rutledge
*Attorney, Agent, or Firm*—Frank Pincelli

[57] ABSTRACT

An apparatus for processing a filmstrip contained in a film cartridge, the filmstrip having a trailing end secured to the cartridge. The apparatus includes at least one processing tank for holding a processing solution therein and a holding mechanism for holding and retaining a film cartridge containing a filmstrip. The holding mechanism includes a reel assembly for receiving and holding a portion of the filmstrip as it exits the film cartridge. The reel assembly capable of being positioned within the at least one processing tank so that the filmstrip will be submersed within a processing solution contained in the at least one processing tank. The apparatus further includes a transport mechanism for moving the holding mechanism along the apparatus so that the holding mechanism can be located the at least one processing tank, an agitation mechanism for agitating the processing solution contained in the tank and causing the processing solution to flow adjacent the filmstrip and a baffle for minimizing the introduction of air into the processing solution within the at least one processing tank.

8 Claims, 4 Drawing Sheets

PHOTOGRAPHIC PROCESSING APPARATUS

FIELD OF THE INVENTION

The present invention relates to the processing of photosensitive material and more particularly to an apparatus for processing photosensitive film while the film is still attached to the film cartridge.

BACKGROUND OF THE INVENTION

Traditional methods for processing photosensitive film contained in cartridges typically involves the separation of the filmstrip from the cartridge prior to processing. In one method, the photographic film is cut away from the cartridge, and taped to a leader board or a length of flexible film, after which the film is drawn through a series of tanks containing the required processing solutions. This method has satisfied the reliability and efficiency requirements for the traditional photofinishing systems, largely due to the fact that the film cartridge is discarded and thus no longer serves any other purposes in subsequent stages of image preparation, storage and retrieval.

Recent advances in film cartridges, such as described in U.S. Pat. No. 4,834,306, disclose a photographic film cartridge wherein the filmstrip may be thrust out of the cartridge, and retracted back into the cartridge a number of times (hereinafter referred to as thrust film cartridge). For example, the thrust film cartridge can be used as a primary storage for the processed film, and can be used with related film handling equipment which can be configured to accept the thrust-type film cartridge. The ability to execute other tasks involved in the preparation, storage and retrieval of images from a specific filmstrip cartridge is advantageous to the photographer and to the photofinisher. In particular, the method of identifying, sorting, and preferentially reproducing (e.g., selecting desired print parameters; such as frame number, size, quantity, setup, and balancing data) images may be significantly enhanced. It has been proposed that the thrusting filmstrip be detached from the thrust film cartridge prior to chemical processing and processed in the traditional photofinishing equipment and then reattached to the original film cartridge (or similar cartridge) for storage.

The detached method exhibits a number of inherent disadvantages. Specifically, the correct filmstrip and cartridge must be reunited; detaching and reattaching the filmstrip can result in damage to the leader and/or trailing edge of the film which then must be cut and reshaped which adds cost to the process; reattaching of the film can be difficult and require certain standardized equipment. Additionally, the detached system cannot take advantage of the fact that only partial portions of the film may be exposed and developed without exposing the remaining portion of the film in the cartridge.

U.S. Pat. No. 5,093,686 discloses the processing of photosensitive material while the filmstrip is still connected to the film cartridge. This is accomplished by thrusting the film out of the cartridge and dipping the filmstrip into successive tanks, typically referred to as the dip and dunk process. The device includes a vertical transport mechanism for lifting the film up to a horizontal transport position where the film can then be moved horizontally while the film is still extended from the cartridge. This type of process results in the images at the bottom end of the strip to experience more development time than the portions above. Additionally, further expensive equipment is required to move and transport the film through the system.

One solution to the foregoing problem is disclosed in U.S. Pat. No. 5,543,882, filed Oct. 27, 1994, by Daniel M. Pagano, Richard B. Wheeler, and Kevin J. Klees, entitled "Method and Apparatus for Processing Photosensitive Film", which is hereby incorporated by reference. This prior invention teaches the use of a propeller immersed in the developing fluid to transport the fluid past the film which is contained in a spiral reel.

This processing technique has proven to provide excellent development uniformity, and will also reduce the development time required. However, both of these desirable effects require high agitation. This is accomplished by turning the propeller at higher speeds. This introduces a new problem by drawing air from the upper surface of the fluid into the flowstream produced by the propeller. This is disadvantageous since it can speed up the oxidation of the developer fluid. Oxidation of the developer reduces its effectiveness and can require more replenishment or more frequent replacement of the developer. An additional deleterious effect is the production of large volumes of foam on the surface of the fluid.

The present invention provides an apparatus for reducing the amount of air drawn into a photographic processing fluid by a high agitation processor. The present invention reduces these troublesome effects by separating the processing tank into an upper and lower segment by the use of a baffle. This horizontal baffle placed above the film holding spiral confines the turbulence of the agitation to the lower section of the tank. The fluid above the baffle is largely undisturbed by the violent agitation below.

SUMMARY OF THE INVENTION

An apparatus for processing a filmstrip contained in a film cartridge, the filmstrip having a trailing end secured to the cartridge. The apparatus includes at least one processing tank for holding a processing solution therein and a holding mechanism for holding and retaining a film cartridge containing a filmstrip. The holding mechanism includes a reel assembly for receiving and holding a portion of the filmstrip as it exits the film cartridge The reel assembly capable of being positioned within the at least one processing tank so that the filmstrip will be submersed within a processing solution contained in the at least one processing tank. The apparatus further includes a transport mechanism for moving the holding mechanism along the apparatus so that the holding mechanism can be located at the least one processing tank, an agitation mechanism for agitating the processing solution contained in the tank and causing the processing solution to flow adjacent the filmstrip and a baffle for minimizing the introduction of air into the processing solution within the at least processing tank.

DETAILED DESCRIPTION OF THE INVENTION

Figure 1:
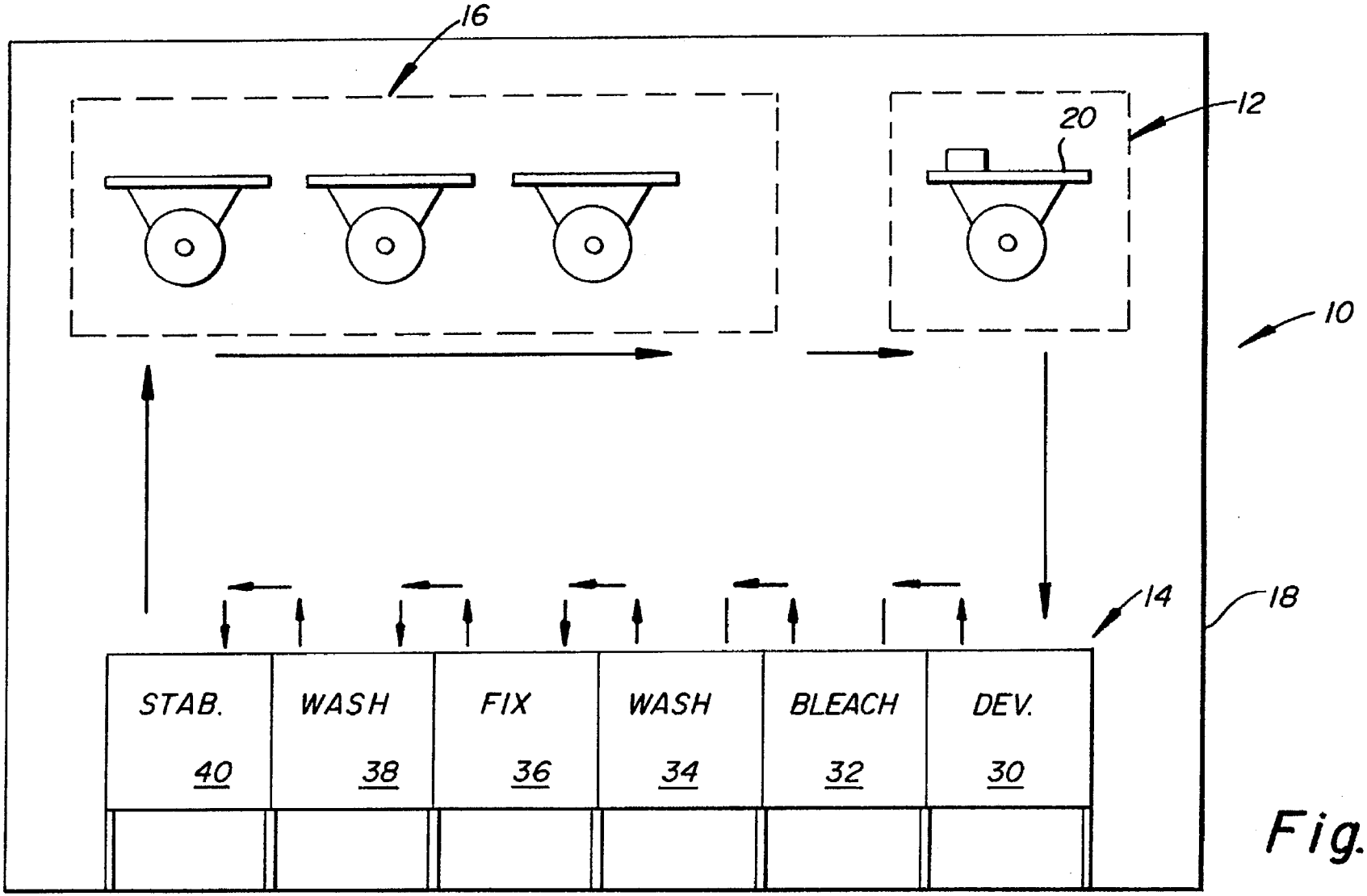
FIG. 1 is a diagrammatic representation of an apparatus made in accordance with the present invention.

Referring to FIG. 1, there is illustrated a processing apparatus 10 made in accordance with the present invention.

The apparatus 10 is designed to process photosensitive material, such as photographic film. In the particular embodiment illustrated, the apparatus is particularly adapted for processing photosensitive film that has been provided in a film thrust-type cartridges such as disclosed in U.S. Pat. No. 4,834,306, commonly assigned to the assignee of the present application and which is hereby incorporated by reference. The apparatus 10 includes a load/unload station 12, a film processing section 14, and a drying section 16. As is typical with such processing apparatus, a housing 18 is provided for containing the load/unload station, film processing section and drying section and for providing a light tight environment within the housing 18. Housing 18 is appropriately sized and configured so as to fully enclose the components and allow access as required. A detailed description of the apparatus 10 and its operation is described in U.S. Pat. No. 5,543,882, filed Oct. 27, 1994, by Daniel M. Pagano, Richard B. Wheeler, and Kevin J. Klees, entitled "Method and Apparatus for Processing Photosensitive Film", which has previously been incorporated herein by reference. The apparatus 10 is designed such that it is possible to process film while the filmstrip is still attached to a film cartridge.

Figure 2:
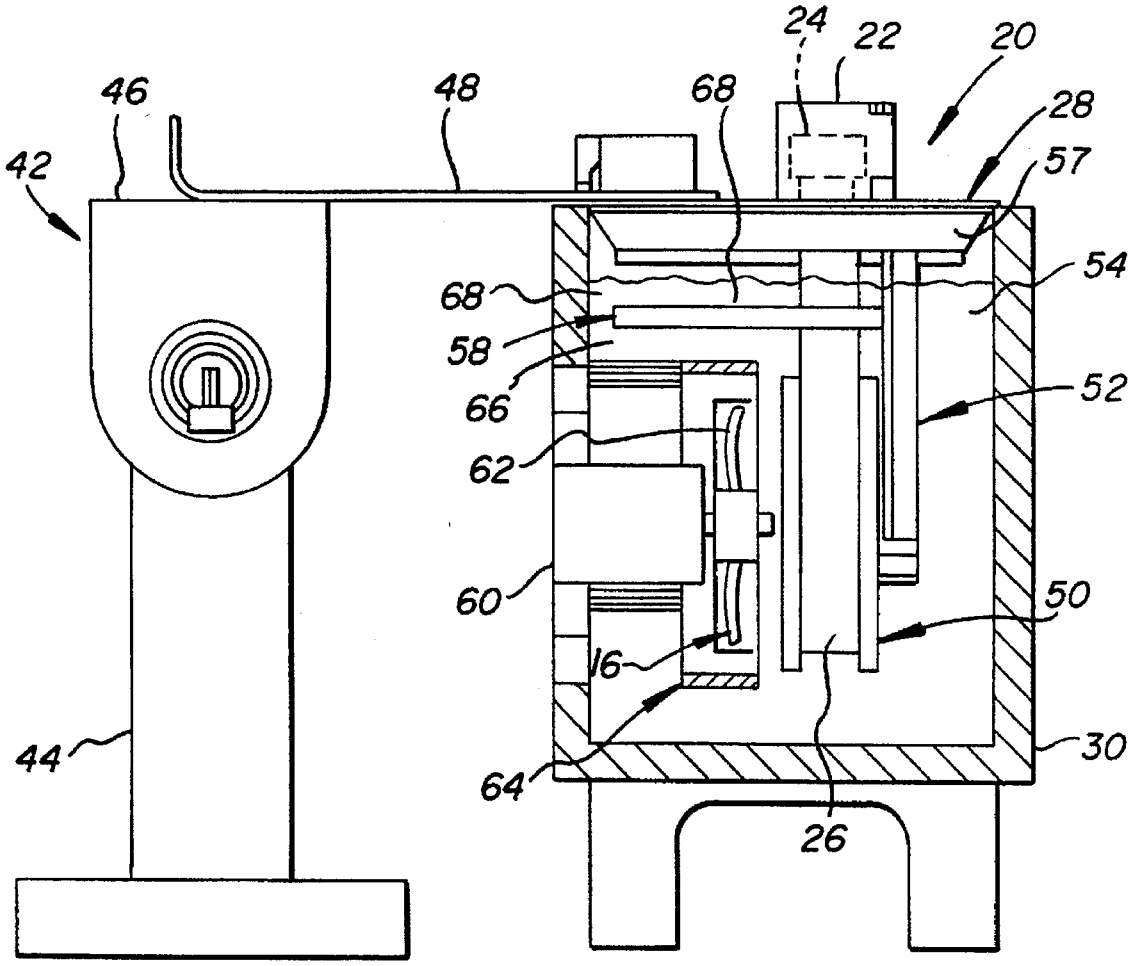
FIG. 2 is a partial section view of the processing section of the apparatus of FIG. 1 illustrating the processing tank, processing fluid, film holding reel, and baffle showing the turbulent and non-turbulent zones.

Referring to FIG. 2, there is illustrated a holding mechanism 20 having nest 22 for holding a film cartridge 24. The cartridge 24 is of the thrust type and contains a filmstrip 26. The holding mechanism further includes a cover 28 designed to mate with at least one processing tank. In the embodiment illustrated, six processing tanks are provided (see FIG. 1). In particular, there is provided a development tank 30 for which contains a a photographic developer solution, a bleach tank 32 containing a photographic bleach solution, a first wash tank 34 containing a wash solution, a fix tank 36 containing a fixing solution, a second wash tank 38 containing a wash solution and a stabilizer tank 40 containing a stabilizing solution. It is, of course, understood that any desired number of processing tanks may be provided each containing the desired processing solution.

Figure 3:
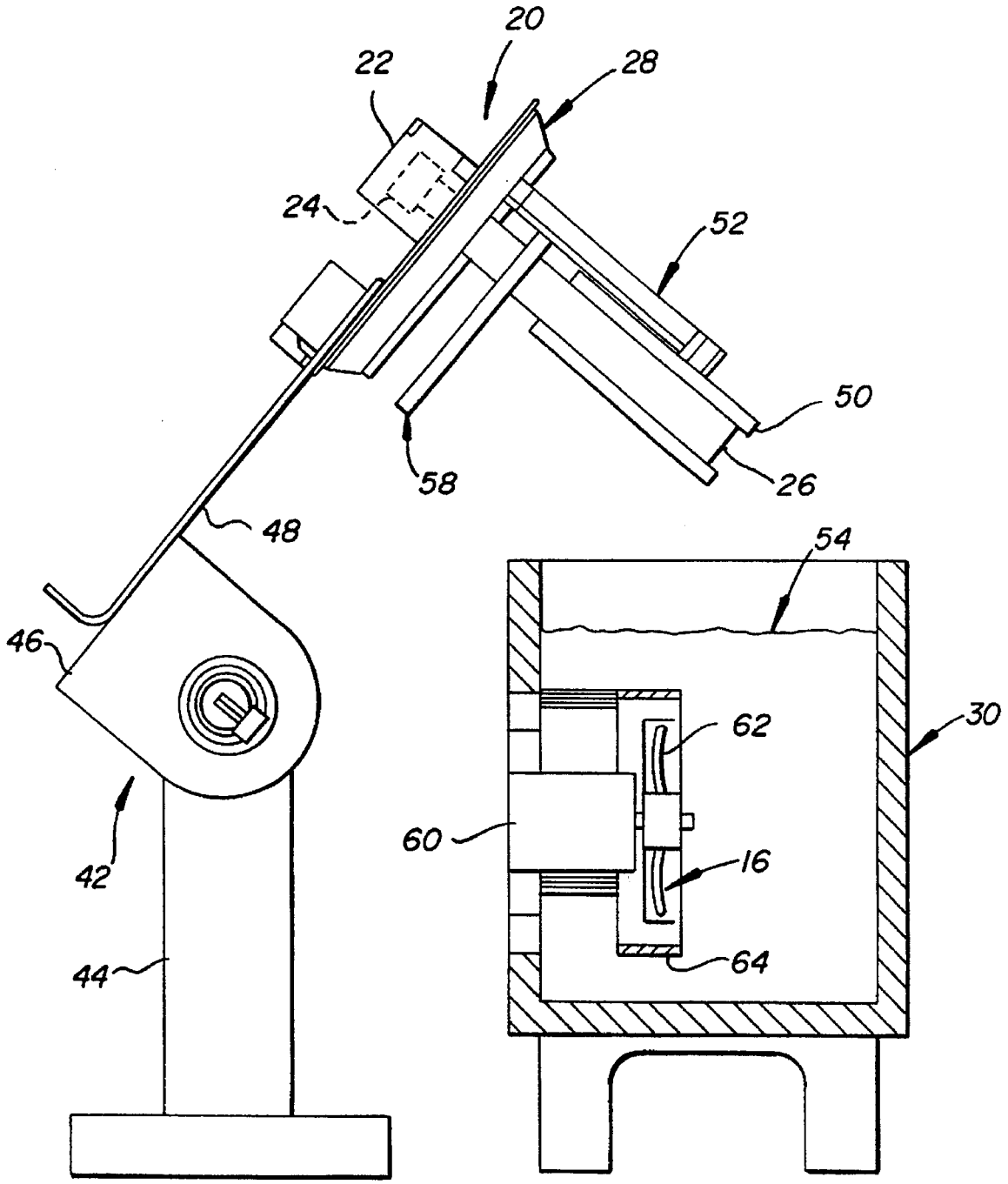
FIG. 3 is a view similar to FIG. 2 showing the baffle, holding reel, and tank cover in the "out of tank" position.

A transport mechanism 42 is provided for transporting the holding mechanism 20 through each of the processing tanks 30,32,34,36,38,40. The transport mechanism includes a base 44 secured to apparatus 10, a mounting block 46 which is rotatably mounted to base 44 and a lift member 48 having one end secured to mounting block 46 and the other end secured to holding mechanism 20. The mounting block 46 is mounted to base 44 such that the holding mechanism 20 may be rotated between an operative position (as shown in FIG. 2) and the transport position (as illustrated in FIG. 3). The mounting block 46 is also capable of being moving in a direction such that the holding mechanism 20 will be moved to a position adjacent to each of the processing tanks 30,32,34,36,38,40. Further details of the transport mechanism 42 and holding mechanism 20 is set forth in the previously referred to Ser. No. 08/330,271 of Pagano, Klees and Wheeler.

The holding mechanism 20 further includes a reel 50 which is used to hold the portion of filmstrip 26 that has been thrusted out of cartridge 24 for processing. The filmstrip 26 is held in a spiral pattern, such that the processing solution can flow between adjacent convolutions of the filmstrip while it is transported through a sequence of processing tanks. A support arm 52 connects reel 50 with tank cover 28. Fluid 54 fills tank 30 to a level between the top of reel 50 and the bottom 56 of tank cover 28. Appropriate means (not shown) is provided for thrusting the portion of filmstrip 26 to be processed out of the cartridge 24 and into reel 50 and then back into cartridge 24, such as described in application Ser. No. 08/330,271, U.S. Pat. No. 5,543,882. The trailing end portion of filmstrip 26 is attached to cartridge 24 as it is being processed. A baffle 58 is attached to support arm 52 and placed above reel 50, but below the top level of fluid 54. A slot (not shown) is used to pass film 26 through baffle 58 and onto reel 50.

Means are provided for agitating and passing the processing solution adjacent the surface of the film while in reel 50. In particular, there is provided a motor 60 having a propeller 62 for providing agitation and causing the processing solution 54 to pass through the reel 50 such that the processing solution 50 is continuously allowed to flow past the emulsion placed on the filmstrip 26. The cover 28 mates with the upper end of the tank so as to provide a substantially sealed processing tank such that when the motor 60 is activated the processing solution will be maintained within the processing tank. A shroud 64 is provided around the periphery of propeller 62 so as to direct the processing solution to reel 50.

Figure 4:
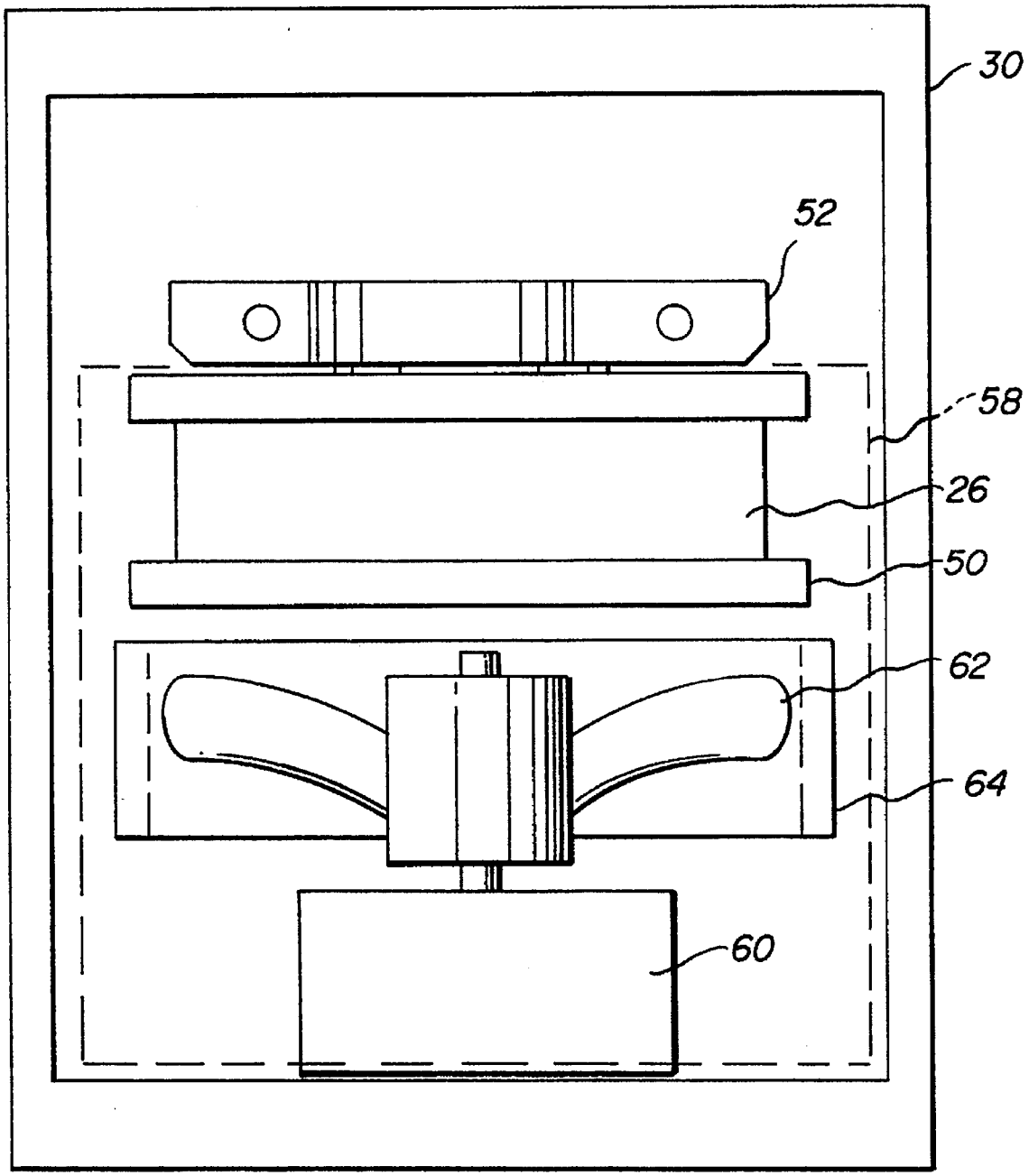
FIG. 4 is top sectional view as taken along line 4—4 of FIG. 2.

When propeller 62 is turning at a high rate of speed (300–3000 revolutions per minute), baffle 58 prevents air from the space between the top of fluid 54 and the bottom of tank cover 57 from being drawn into the flowstream created through cylindrical shroud 64 and through reel 50. The baffle 58 is located below the surface of the processing solution 54 and disposed above the agitation means, that is, the propeller 62. The baffle is preferably equal to or greater than the projected area above the agitation means 63, the reel 50, and shroud 64 (as illustrated by dash lines in FIG. 4). The baffle divides the processing solution into two regions. In particular a turbulent region 66 below baffle 58 and relatively calm region 68 above the baffle 58. This results in the surface of the processing solution being subject to minimal agitation, thus minimizing oxidation of the processing solution.

FIG. 3 shows the tank cover 28, support arm 52, reel 50, filmstrip 26, and baffle 58 in a raised position for transport to an adjacent tank. It should be noted that although baffle 58 is attached to support arm 52 in this embodiment, this is not the only possible embodiment. Baffle 58 could be mounted inside tank 30 and moved out of the way when the holding mechanism 20 is placed into, or removed from tank 30.

It is to be understood that various other changes and modifications may be made without departing from the scope of the present invention. The present invention being defined by the following claims:

Parts List

10—processing apparatus
12—load/unload station
14—film processing section
16—drying section
18—housing
20—holding mechanism
22—nest
24—film cartridge
26—filmstrip
28—cover
30—development tank
32—bleach tank
34—wash tank
36—fix tank
40—stabilizer tank
42—transport mechanism
44—base
46—mounting block 48—lift member
50—reel
52—support arm
54—fluid
56—bottom
57—tank cover
58—baffle
60—motor
62—propeller
63—agitation means
64—shroud
66—turbulent region
68—calm region

We claim:

1. An apparatus for processing a filmstrip contained in a film cartridge, said filmstrip having a trailing end secured to the cartridge, said apparatus comprising:

at least one processing tank containing a processing solution therein;

a holding mechanism for holding and retaining a film cartridge containing a filmstrip, said holding mechanism includes a reel for receiving and holding a portion of the filmstrip as it exits the film cartridge, said reel capable of being positioned within said at least one processing tank so that the filmstrip will be submersed within the processing solution contained in said at least one processing tank;

a transport mechanism for moving said holding mechanism along said apparatus so that said holding mechanism can be located said at least one processing tank;

an agitation mechanism for agitating the processing solution contained in said tank and causing the processing solution to flow adjacent said filmstrip; and a baffle plate disposed above said agitation mechanism and below the surface of said processing solution for minimizing the introduction of air into the processing solution within the at least one processing tank.

2. The apparatus according to claim 1 wherein said means for minimizing the introduction of air into the processing solution within the at least one processing tank is attached to said holding mechanism.

3. The apparatus according to claim 1 wherein said agitation means comprises a propeller, said baffle plate is disposed above said propeller and said reel.

4. The apparatus according to claim 1 further comprising a film drive mechanism for moving the filmstrip out of, or back into, the film cartridge while the trailing end of the filmstrip remains attached to the cartridge.

5. An apparatus for processing a filmstrip, said apparatus comprising:

at least one processing tank containing a processing solution therein;

a holding mechanism for holding and retaining a film cartridge containing a filmstrip, said holding mechanism includes a reel a for receiving and holding a portion of the filmstrip, said reel capable of being positioned within said at least one processing tank so that the filmstrip will be submersed within the processing solution contained in said at least one processing tank;

an agitation mechanism for agitating the processing solution contained in said tank and causing the processing solution to flow adjacent said filmstrip contained is said reel; and a baffle plate disposed above said agitation mechanism and below the surface of said processing solution for minimizing the introduction of air into the processing solution within the at least one processing tank.

6. The apparatus according to claim 5 wherein said means for minimizing the introduction of air into the processing solution within the at least one processing tank is attached to said holding mechanism.

7. The apparatus according to claim 5 wherein said agitation means comprises a propeller and said holding mechanism comprises a reel for holding of said filmstrip, said baffle plate is disposed above said propeller and said reel.

8. The apparatus according to claim 5 further comprising a film drive mechanism for moving the filmstrip out of, or back into, the film cartridge while the trailing end of the filmstrip remains attached to the cartridge.

* * * * *